US006715532B1

(12) United States Patent
Lin

(10) Patent No.: US 6,715,532 B1
(45) Date of Patent: Apr. 6, 2004

(54) WINDOW SCREEN

(76) Inventor: Ya-Yin Lin, No. 598, Lu-Tsao, Hsi-Ching Tsun, Lu-Tsao Hsiang, Chia-Yi Hsien (TW)

( * ) Notice: Subject to any disclaimer, the term of this patent is extended or adjusted under 35 U.S.C. 154(b) by 0 days.

(21) Appl. No.: 10/307,064

(22) Filed: Nov. 26, 2002

(51) Int. Cl.[7] ..... A47H 33/00
(52) U.S. Cl. ..... 160/405; 160/238; 160/DIG. 7
(58) Field of Search ..... 160/405, DIG. 7, 160/238, 370.21, 327, 354, 368.1, 237

(56) References Cited

U.S. PATENT DOCUMENTS 1,203,758 A * 11/1916 Lowe ..... 160/DIG. 7
2,071,921 A * 2/1937 Dickson ..... 160/DIG. 7
4,078,492 A * 3/1978 Levy et al. ..... 160/238 X
4,247,599 A * 1/1981 Hopper ..... 160/121.1
4,358,488 A * 11/1982 Dunklin et al. ..... 160/DIG. 7
4,910,070 A * 3/1990 Al'Hariri ..... 428/181
5,400,848 A * 3/1995 Gainer ..... 160/238
5,443,563 A * 8/1995 Hindel et al. ..... 160/238

* cited by examiner

*Primary Examiner*—David Purol
(74) *Attorney, Agent, or Firm*—Rodman & Rodman

(57) ABSTRACT

A window screen includes a screen sheet with two opposite outer side surfaces. The screen sheet includes a pair of screen laminates, and an intermediate bonding layer. Each screen laminate has a first surface facing the other screen laminate, and a second surface opposite to the first surface. The bonding layer is attached to the first surfaces of the screen laminates for bonding together the screen laminates. The bonding layer is formed from a resin composition that contains a dark-colored oil-based ink. The second surfaces of the screen laminates constitute the opposite outer side surfaces of the screen sheet.

15 Claims, 5 Drawing Sheets

WINDOW SCREEN

BACKGROUND OF THE INVENTION

1. Field of the Invention

The present invention relates to a window screen, more particularly to a window screen adapted to be installed in a room at an inner side of a window for blocking sunlight through the window.

2. Description of the Related Art

A first conventional window screen includes a PVC screen sheet wound on a winding mechanism and operable for moving between retracted and extended positions. The screen sheet includes an inner screen laminate in a color conforming to that of an interior of a room to which the window screen is to be applied, and an outer screen laminate adhered to the inner screen laminate and to be disposed to face the window. To provide a sun-blocking effect, the outer screen laminate is typically in a dark color. However, the dark-colored outer screen laminate is visible from an exterior of the house to result in a disharmonious appearance of the house when the house has a light-colored outer wall surface.

To solve the aforementioned problem, another conventional window screen with a three-layered structure has been proposed heretofore. Referring to FIG. 1, the window screen 1 is shown to include two outer screen laminates 11, 12 and an inner screen laminate 13 disposed between the outer screen laminates 11, 12. Each of the screen laminates 11, 12, 13 is formed from a polyvinyl chloride film. The outer screen laminates 11, 12 may be made in colors conforming respectively to the interior of a room and the outer wall surface of a house. The intermediate screen laminate 13 is dark-colored, such as black, so as to achieve the desired sunlight-blocking effect.

During manufacture, the inner screen laminate 13 is disposed between the outer screen laminates 11, 12. The screen laminates 11, 12, 13 are passed simultaneously through a bonding machine 14 for bonding together the inner and outer screen laminates 11, 12, 13 so as to form the window screen 1. However, the bonding process involves high costs. In addition, the window screen 1 produced by the bonding process was found to have creased surfaces. To eliminate creases, the screen laminates 11, 12, 13 are initially tensioned before passing through the bonding machine. This, however, results in curled corners in the window screen 1 produced thereby. Moreover, when it is desired to form a pattern on the window screen 1, the pattern is initially formed on the inner screen laminate 13 by punching. As such, the tension of the inner screen laminate 13 cannot be properly controlled during the bonding process.

SUMMARY OF THE INVENTION

The main object of the present invention is to provide a window screen capable of solving the aforesaid problems of the prior art.

Accordingly, the window screen of the present invention includes a screen sheet having opposite outer side surfaces. The screen sheet includes a pair of screen laminates, each of which has a first surface facing the other one of the screen laminates, and a second surface opposite to the first surface, and an intermediate bonding layer attached to the first surfaces of the screen laminates for bonding together the screen laminates. The bonding layer is formed from a liquid resin composition that contains an oil-based ink. The second surfaces of the screen laminates constitute the outer side surfaces of the screen sheet, respectively.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
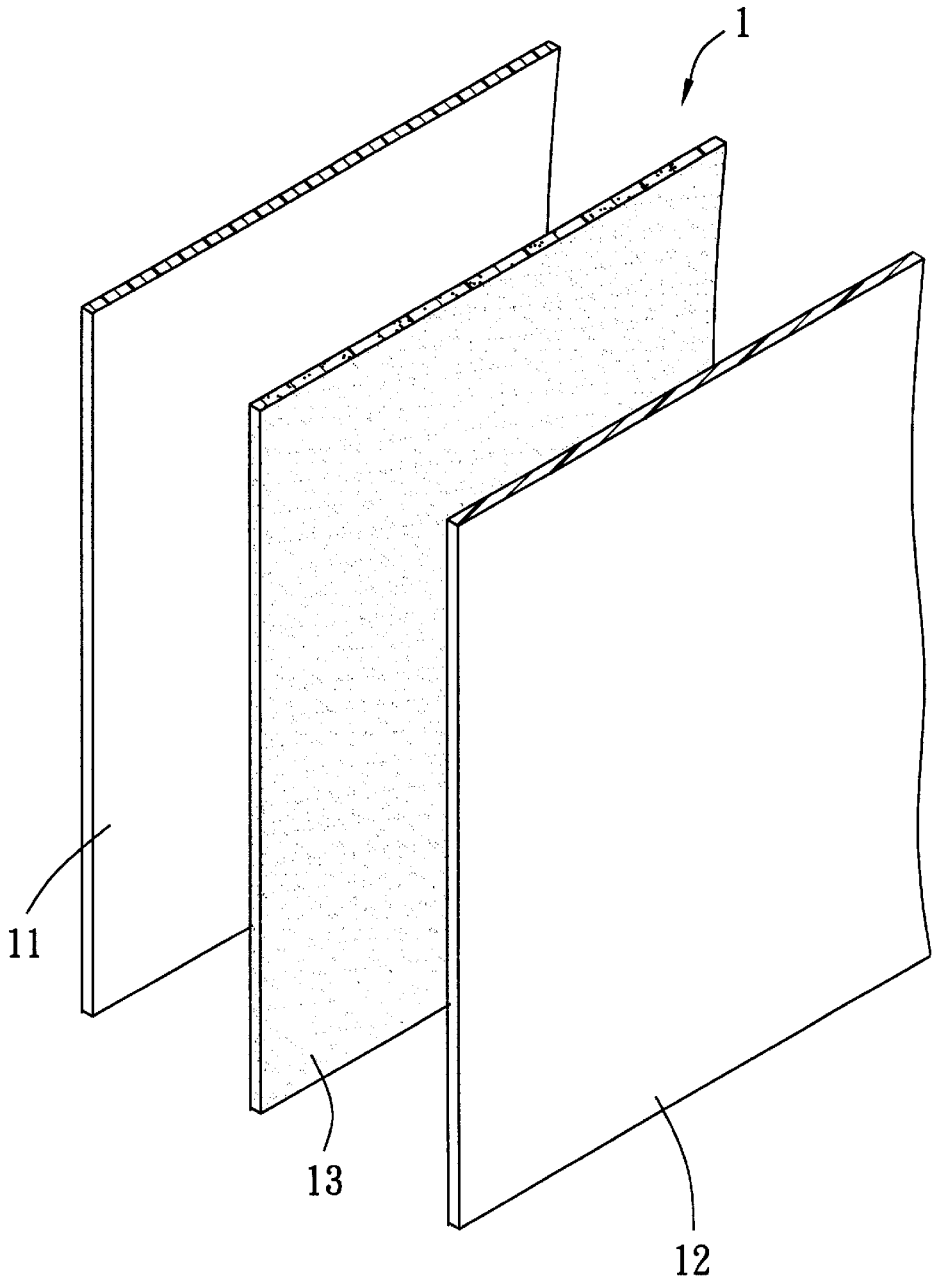
FIG. 1 PRIOR ART
FIG. 1 is an exploded fragmentary perspective view illustrating screen laminates from which a conventional window screen is formed.
Figure 2:
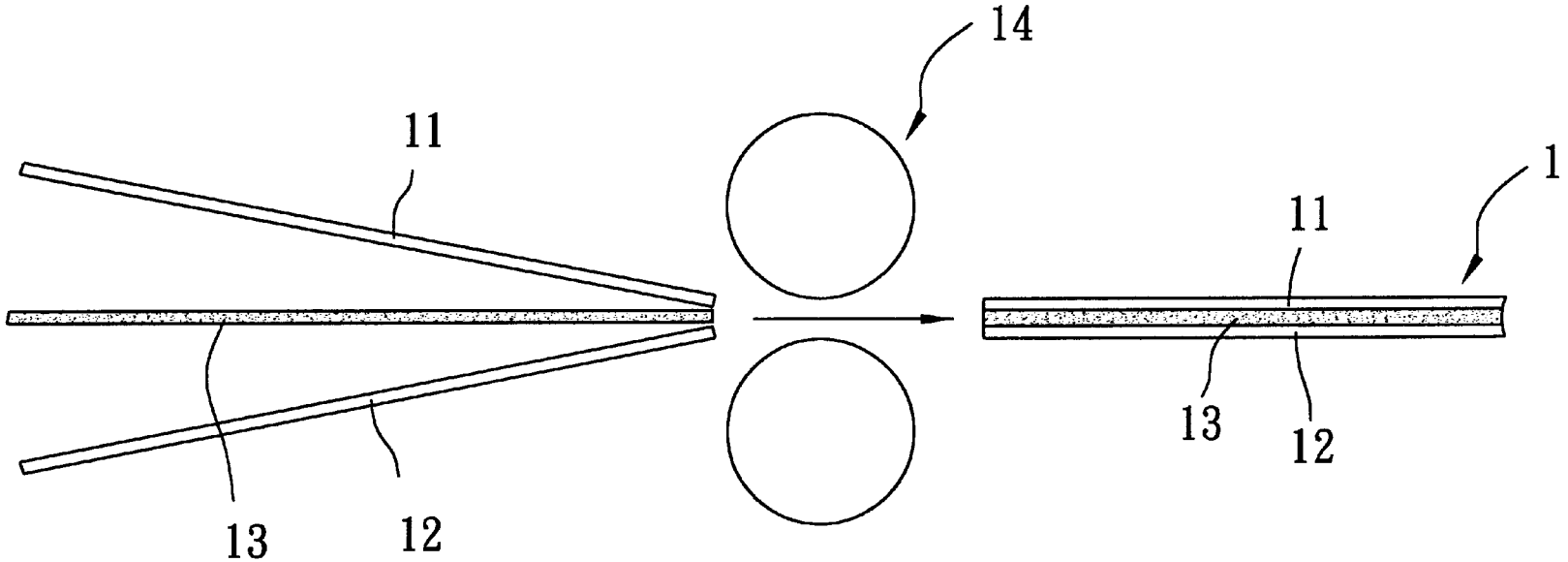
FIG. 2 PRIOR ART
FIG. 2 is a schematic view illustrating a bonding process for the manufacture of the conventional window screen of FIG. 1.
Figure 3:
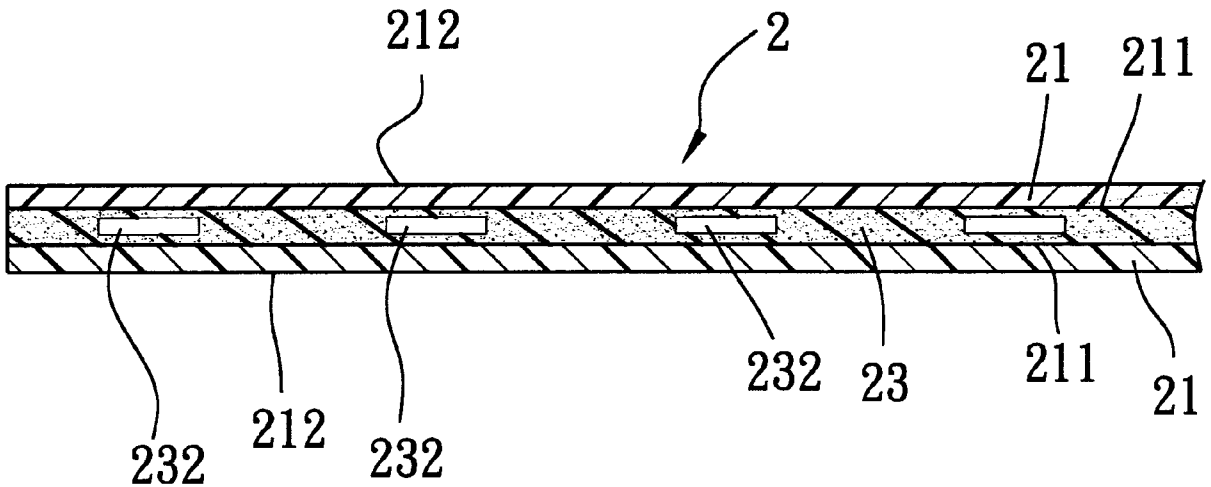
FIG. 3 is a cross-sectional view of a preferred embodiment of the window screen of the present invention.

Referring to FIG. 3, the preferred embodiment of the window screen according to the present invention is shown to include a screen sheet 2 adapted to be installed in an interior of a room at an inner side of a window for blocking sunlight through the window. The screen sheet 2 includes first and second screen laminates 21, and an intermediate bonding layer 23 disposed between the screen laminates 21. Each of the first and second screen laminates 21 is formed from a thin sheet of a light-colored plastic material, such as a polyvinyl chloride resin, with a thickness of about 0.05~0.1 mm. Each of the screen laminates 21 has a first surface 211 facing the other one of the screen laminates 21, and a second surface 212 opposite to the first surface 211. The intermediate bonding layer 23 is attached to the first surfaces 211 of the screen laminates 21, and has a thickness in the range of 0.02·0.04 mm. The intermediate bonding layer 23 is formed from a liquid resin composition, which contains a PVC polymer commercially available from Formosa Plastics Corporation of Taiwan under the trade name S-65, and a dark-colored oil-based ink, such as a black ink. Optionally, the intermediate bonding layer 23 has patterned portions formed with cavities 232 therein. The cavities 232 may be arranged to cooperatively form a predetermined pattern on the bonding layer 23. The second surfaces 212 of the screen laminates 21 constitute opposite outer side surfaces of the screen sheet 2. The opposite outer side surfaces, i.e., the second surfaces 212 of the screen laminates 21, are adapted to face the window and the interior of the room, respectively.

Figure 4:
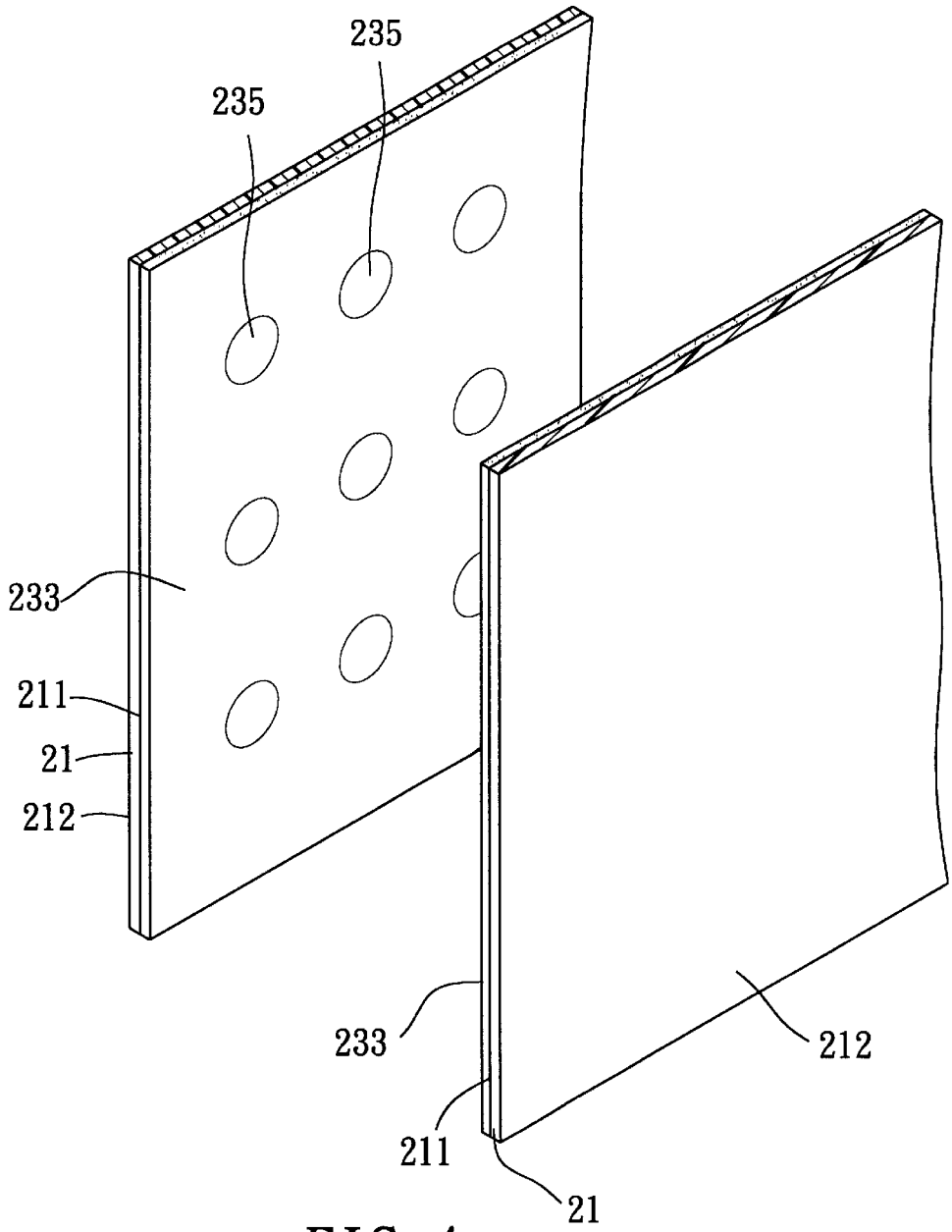
FIG. 4 is a perspective view, illustrating two screen laminates for forming the window screen of FIG. 3, before passing through a bonding machine.
Figure 5:
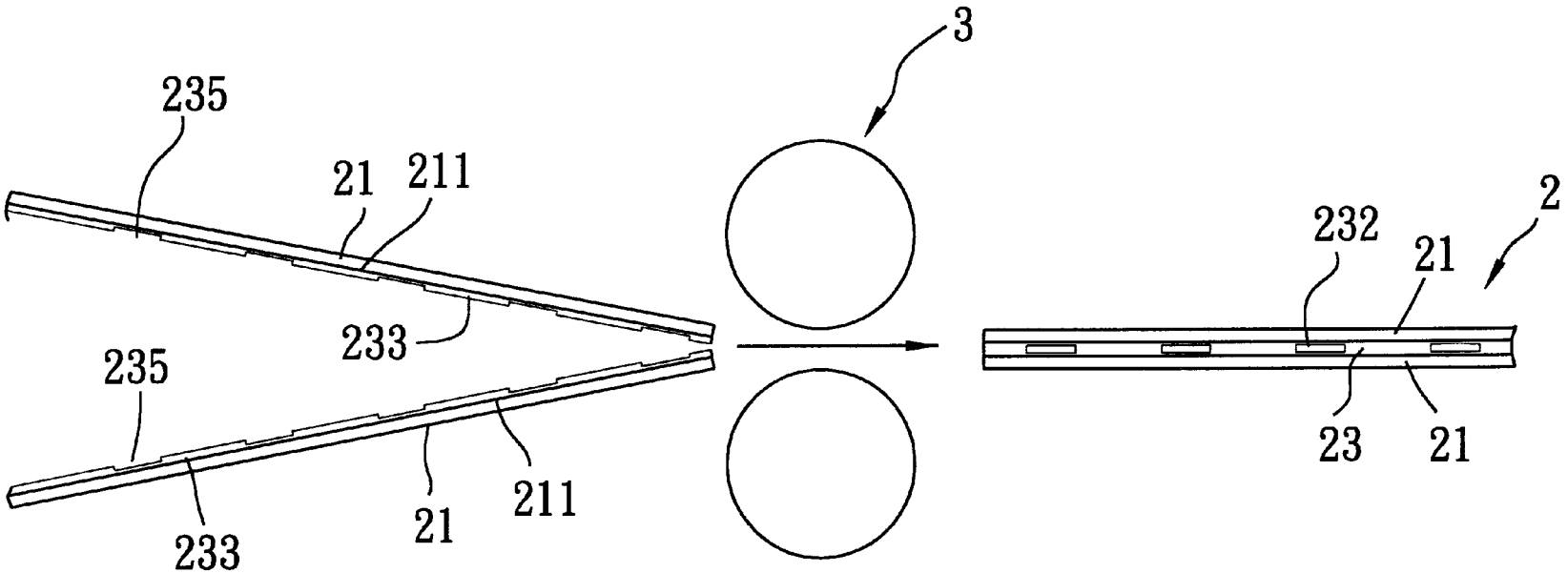
FIG. 5 is a schematic view illustrating a bonding process for the manufacture of the window screen of FIG. 3.

Referring to FIGS. 4 and 5, during manufacture, the screen laminates 21 are initially produced from polyvinyl chloride. The first surface 211 of each of the screen laminates 21 is then applied with a resin film 233 using a coating roller. The resin film 233 includes the aforementioned liquid resin composition, which contains the PVC polymer and the black ink. The resin films 233 on the first surfaces 211 of the screen laminates 21 are bonded together by passing the screen laminates 21 simultaneously through a bonding machine under heat and pressure, with the resin films 233 confronting each other. The resin films 233 are thus bonded together to cooperatively form the intermediate bonding layer 23 between the screen laminates 21. To form the cavities 232. (see FIG. 3) in the bonding layer 23, the coating roller is provided with patterns thereon so as to form confronting depressed portions 235 in the resin films 233. The depressed portions 235 in the resin films 233 on the first surfaces 211 of the screen laminates 21 cooperatively form the cavities 232 after the screen laminates 21 are bonded together. Since the bonding layer 23 is dark-colored and provides a sunlight-blocking effect, the provision of the cavities 232 in the intermediate bonding layer 23 results in a reduction in the thickness of the bonding layer 23 at the patterned portions, thereby resulting in increased sunlight transmittance through the patterned portions of the bonding layer 23. In the present embodiment, the cavities, 232 are circular in shape and are arranged in rows. In other embodiments, the cavities may cooperatively form a picture, a design or a cartoon character, etc.

As a modification, in other embodiments, the patterned portions of the bonding layer 23 may be formed to have an increased thickness to result in reduced sunlight transmittance therethrough.

During the bonding process, a design may be formed by carving on any of the screen laminates 21 using the bonding machine 3. Moreover, during manufacture, it is possible that the first surface 211 of only one of the screen laminates 21 is applied with the resin film 233, which then forms the intermediate bonding layer 23 after the screen laminates 21 pass through the bonding machine.

Since the bonding layer 23 is dark-colored to render the screen sheet 2 to have an excellent sunlight-blocking effect, the screen laminates 21 may be formed in light colors to conform with the inner and outer wall surfaces of the room and the house to which the screen sheet 2 is applied. In addition, the screen sheet 2 produced according to the present invention is relatively flat and does not experience the problems of creased surfaces and curled corners. The manufacturing process for the window screen of this invention involves simple coating and bonding steps, and a low manufacturing cost.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A window screen, comprising:

a screen sheet produced by a process which includes the following steps:

a) forming two screen laminates from a plastic material, each of said screen laminates having opposite first and second surfaces;

b) coating at least one of said first surfaces of said screen laminates with a resin composition to form a resin film on said at least one of said first surfaces of said screen laminates, said resin composition containing a dark-colored oil-based ink; and c) bonding together said first surfaces of said screen laminates so as to form an intermediate bonding layer between said screen laminates.

2. The window screen as claimed in claim 1, wherein said resin composition further contains a PVC polymer.

3. The window screen as claimed in claim 1, wherein said plastic material contains polyvinyl chloride.

4. The window screen as claimed in claim 1, wherein said intermediate boding layer has a thickness in the range of 0.02 mm~0.04 mm.

5. The window screen as claimed in claim 1, wherein, in step b), said resin film formed on said at least one of said first surfaces of said screen laminates includes at least one portion with a reduced thickness.

6. The window screen as claimed in claim 5, wherein said portion is patterned.

7. A window screen, comprising:

a screen sheet having opposite outer side surfaces, said screen sheet including:

a pair of screen laminates, each of which has a first surface facing the other one of said screen laminates, and a second surface opposite to said first surface; and an intermediate bonding layer attached to said first surfaces of said screen laminates for bonding together said screen laminates, said bonding layer being formed from a resin composition which contains an oil-based ink;

said second surfaces of said screen laminates constituting said outer side surfaces of said screen sheet, respectively.

8. The window screen as claimed in claim 7, wherein said resin composition further contains a PVC polymer.

9. The window screen as claimed in claim 7, wherein each of said screen laminates is formed from polyvinyl chloride.

10. The window screen as claimed in claim 7, wherein each of said screen laminates is light-colored, and said oil-based ink in said resin composition of said bonding layer is dark-colored.

11. The window screen as claimed in claim 10, wherein said intermediate bonding layer has a thickness in the range of 0.02~0.04 mm.

12. The window screen as claimed in claim 10, wherein said intermediate bonding layer has at least a portion with a reduced thickness.

13. The window screen as claimed in claim 12, wherein said portion is patterned.

14. The window screen as claimed in claim 10, wherein said intermediate bonding layer has at least a portion formed with at least one cavity to result in increased light-transmittance through said portion of said intermediate bonding layer.

15. The window screen as claimed in claim 14, wherein said portion is patterned.

* * * * *